US009779899B1

(12) United States Patent
McMahon et al.

(10) Patent No.: US 9,779,899 B1
(45) Date of Patent: Oct. 3, 2017

(54) SWITCH ASSEMBLY AND METHOD OF OPERATING SAME

(71) Applicant: Delta Systems, Inc., Streetsboro, OH (US)

(72) Inventors: Michael McMahon, Salem, OH (US); Tony Aboumrad, North Royalton, OH (US); Isaac Kirbawy, Tallmadge, OH (US)

(73) Assignee: Delta Systems, Inc., Streetsboro, OH (US)

( * ) Notice: Subject to any disclaimer, the term of this patent is extended or adjusted under 35 U.S.C. 154(b) by 509 days.

(21) Appl. No.: 14/593,456

(22) Filed: Jan. 9, 2015

Related U.S. Application Data

(60) Provisional application No. 61/925,503, filed on Jan. 9, 2014, provisional application No. 62/083,999, filed on Nov. 25, 2014.

(51) Int. Cl.
*H01H 27/10* (2006.01)
*H01H 36/00* (2006.01)
*H01H 9/02* (2006.01)

(52) U.S. Cl.
CPC ..... *H01H 27/10* (2013.01); *H01H 9/02* (2013.01); *H01H 36/0033* (2013.01); *H01H 2221/052* (2013.01); *H01H 2221/056* (2013.01); *H01H 2223/014* (2013.01); *H01H 2300/026* (2013.01)

(58) Field of Classification Search
CPC ..... H01H 36/0033; H01H 9/02; H01H 27/10; H01H 2221/014; H01H 2221/52; H01H 2221/56; H01H 2300/026
See application file for complete search history.

(56) References Cited

U.S. PATENT DOCUMENTS

| | | | | |
|---|---|---|---|---|
| 3,812,403 | A * | 5/1974 | Gartner | G07C 9/00698 307/10.4 |
| 4,369,745 | A | 1/1983 | Howard | |
| 4,795,865 | A | 1/1989 | Howard | |
| 4,812,604 | A | 3/1989 | Howard | |
| 4,839,478 | A | 6/1989 | Howard | |
| 4,894,019 | A | 1/1990 | Howard | |
| 4,924,046 | A | 5/1990 | Howard | |
| 5,221,816 | A | 6/1993 | Williams | |
| 5,424,502 | A | 6/1995 | Williams | |
| 5,528,007 | A | 6/1996 | Williams et al. | |
| 5,548,888 | A | 8/1996 | Williams | |
| 5,613,598 | A | 3/1997 | Pittman et al. | |

(Continued)

*Primary Examiner* — Thomas J Hiltunen
(74) *Attorney, Agent, or Firm* — Tarolli, Sundheim, Covell & Tummino LLP; John A. Yirga, Esq.

(57) ABSTRACT

A switch assembly and method for use with power equipment, the switch assembly comprises a housing assembly for having an actuator opening, the opening defining spaced first and second internal housing positions and a removably located actuator for selectively positioning within the opening of the housing assembly for altering the operation of power equipment. The switch assembly further includes a first switch corresponding to the first housing position to selectively provide power to one or more components of the power equipment and a second switch corresponding to the second housing position such that the second switch is spaced away from the first housing position, the second switch for detecting the presence and position of the actuator such to further alter the operation of power equipment.

15 Claims, 18 Drawing Sheets

(56) References Cited

U.S. PATENT DOCUMENTS

| | | | | |
|---|---|---|---|---|
| 5,756,947 | A | 5/1998 | Trimble, Jr. et al. | |
| 5,775,482 | A | 7/1998 | Wolfe et al. | |
| 5,818,330 | A * | 10/1998 | Schweiger | B60R 25/02 123/179.2 |
| 6,207,910 | B1 | 3/2001 | Harvey et al. | |
| 6,457,545 | B1 | 10/2002 | Michaud et al. | |
| 6,483,061 | B1 | 11/2002 | Harvey et al. | |
| D472,883 | S | 4/2003 | Harvey | |
| 6,543,560 | B1 | 4/2003 | Trefz et al. | |
| 6,618,022 | B2 | 9/2003 | Harvey | |
| 6,648,092 | B2 | 11/2003 | Michaud et al. | |
| D500,744 | S | 1/2005 | Michaud | |
| 6,868,925 | B2 | 3/2005 | Trefz et al. | |
| 7,064,639 | B2 | 6/2006 | Harvey et al. | |
| 7,071,436 | B2 * | 7/2006 | Coates | H01H 27/00 200/330 |
| 7,168,519 | B2 | 1/2007 | Harvey et al. | |
| D558,155 | S | 12/2007 | Michaud et al. | |
| 7,322,337 | B1 * | 1/2008 | Brister | B60K 15/0406 123/198 D |
| 7,488,914 | B2 | 2/2009 | Kahnert et al. | |
| D597,962 | S | 8/2009 | Albrecht | |
| 7,629,543 | B2 | 12/2009 | Kahnert | |
| 7,679,491 | B2 * | 3/2010 | Costello | B60R 25/04 307/10.3 |
| 7,812,473 | B2 | 10/2010 | Larsen et al. | |
| 8,171,907 | B2 | 5/2012 | Koenen et al. | |
| 8,256,197 | B2 | 9/2012 | Kahnert | |
| 8,516,985 | B2 | 8/2013 | Koenen et al. | |
| 8,763,579 | B2 | 7/2014 | Koenen et al. | |
| 8,835,821 | B2 * | 9/2014 | Zeijlon | H05B 6/6435 219/704 |
| 8,921,724 | B2 | 12/2014 | Young | |
| 9,053,877 | B2 | 6/2015 | Young | |
| 9,171,682 | B2 * | 10/2015 | Sugihara | H01H 9/0207 |
| 9,488,149 | B2 | 11/2016 | Koenen et al. | |
| 9,624,890 | B2 * | 4/2017 | Koenen | F02N 11/0803 |
| 9,624,891 | B2 * | 4/2017 | Koenen | F02N 11/0803 |
| 2014/0104796 | A1 | 4/2014 | Nohra et al. | |
| 2014/0332357 | A1 | 11/2014 | Kirbawy | |
| 2014/0345555 | A1 * | 11/2014 | Koenen | F02N 11/0803 123/179.3 |
| 2016/0257286 | A1 * | 9/2016 | Bianchi | B60R 25/04 |

* cited by examiner

SWITCH ASSEMBLY AND METHOD OF OPERATING SAME

CROSS REFERENCES TO RELATED APPLICATIONS

The following application claims priority under 35 U.S.C. §119(e) to U.S. Provisional Patent Application Ser. No. 61/925,503 filed Jan. 9, 2014 entitled SWITCH ASSEMBLY AND METHOD OF OPERATING SAME and U.S. Provisional Patent Application Ser. No. 62/083,999 filed Nov. 25, 2014 entitled SWITCH ASSEMBLY AND METHOD OF OPERATING SAME. The above-identified applications from which priority is claimed are incorporated herein by reference their entireties for all purposes.

TECHNICAL FIELD

The present disclosure relates to electrical switches, and more particularly to a switch assembly and method of operation that includes an enablement switch arrangement having a selectable mode operation between an operable state and a non-operable state of a piece of equipment.

BACKGROUND

Heavy pieces of equipment, such as lawn mowers, tractors, tillers, cranes, and the like, are typically operated using an ignition switch. Accidental engagement of the ignition switch can cause unintentional operation of the piece of equipment. Such unintentional operations can result in damage to an external structure (e.g., a building), a person, or both.

SUMMARY

One aspect of the present disclosure includes a switch assembly and method for use with power equipment. The switch assembly comprises a housing assembly having an actuator opening, the opening defining spaced first and second internal housing positions and a removably located actuator for selectively positioning within the opening of the housing assembly for altering the operation of power equipment. The switch assembly further includes a first switch corresponding to the first housing position to selectively provide power to one or more components of the power equipment and a second switch corresponding to the second housing position such that the second switch is spaced away from the first housing position, the second switch for detecting the presence and position of the actuator such to further alter the operation of power equipment.

Another aspect of the present disclosure includes a switch assembly for use with power equipment, the switch assembly comprising: a housing assembly defined by a first and second housing position; a removably located actuator for selectively positioning within the first and second housing positions to alter the operation of power equipment; a circuit comprising: a first switch corresponding to the first housing position; a second switch corresponding to the second housing position; and a microcontroller to receive and process signals, wherein the first and second switches detect the presence and position of the actuator in the first and second housing positions such to alter a signal to the microcontroller, wherein a signal from the first switch indicating the actuator is in a first housing position enables at least one component of the power equipment, and a signal from the second switch indicates the actuator is in the second housing position enabling a microcontroller to execute instructions controlling at least one component of the power equipment.

While another aspect of the present disclosure includes a method for using a switch assembly to activate power equipment comprising: inserting a removable actuator into a first housing position of a housing assembly; activating a first switch corresponding to the first housing position, the switch to selectively provide power to one or more components of the power equipment; inserting the removable actuator into the second housing position of a housing assembly; and activating a second switch corresponding to the second housing position, the second switch to provide a control signal enabling the microcontroller to execute instructions to operate at least one component of the power equipment.

BRIEF DESCRIPTION OF THE DRAWINGS

The foregoing and other features and advantages of the present disclosure will become apparent to one skilled in the art to which the present disclosure relates upon consideration of the following description of the disclosure with reference to the accompanying drawings, wherein like reference numerals refer to like parts unless described otherwise throughout the drawings and in which.

DETAILED DESCRIPTION

Referring now to the figures generally wherein like numbered features shown therein refer to like elements throughout unless otherwise noted. The present disclosure relates to electrical switches, and more particularly to a switch assembly and method of operation that includes an enablement switch arrangement having a selectable mode operation between an operable state and a non-operable state of a piece of equipment.

Figure 1:
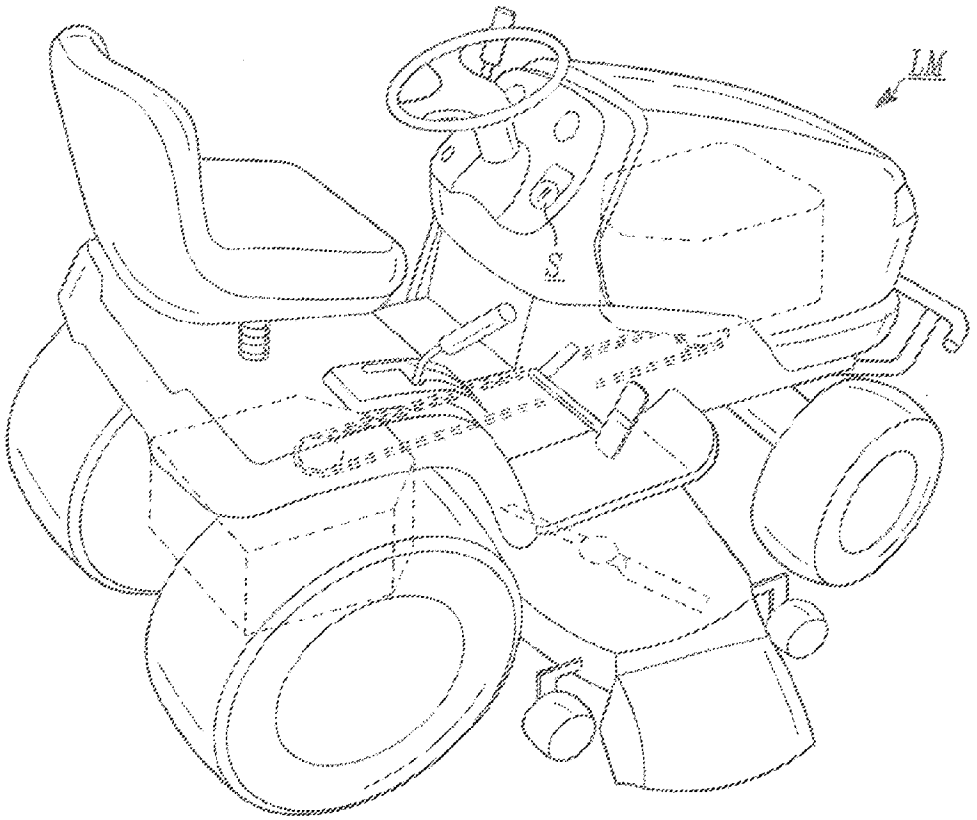
FIG. 1 is a perspective view of a tractor configured for use with a switch assembly.

FIG. 1 illustrates a lawn mower LM with a socket S for receiving an enablement switch assembly 10 constructed in accordance with one example embodiment of the present disclosure. Although FIG. 1 shows the lawn mower LM, it will be appreciated that the enablement switch assembly 10 can be used with any other suitable use of heavy equipment e.g., cranes, tractors, watercraft, snow mobiles, all terrain vehicles (ATVs), and the like.

FIGS. 2-11 illustrate an enablement switch assembly 10 constructed in accordance with one example embodiment of the present disclosure. The enablement switch assembly 10, as would be appreciated by one of ordinary skill in the art, can operate as a kill switch, based on the construction of the switch assembly, as further discussed below. In the illustrated example embodiment shown in FIGS. 1-10, the enablement switch assembly 10 includes an actuator 12 and a housing assembly 14.

As described in more detail below, the actuator 12 is selectively removable from the housing assembly 14. The actuator 12 can include a housing 16, a stem 18 extending from a bottom surface 132 of the housing 16, and a handle 20 disposed within a portion of the housing 16. The housing 16 is generally circular. The stem 18 is generally cylindrical and includes a hollow interior (not shown) for receiving a magnet 22 (described below). The handle 20 can be configured as a lever for a user to grip and install or remove the actuator 12 from the housing assembly 14. The housing 16, the stem 18, and the handle 20 are each made of a metal (e.g., aluminum, stainless steel, etc.) or a non-metal (e.g., plastic).

The magnet 22 is generally cylindrical. The magnet 22 is also sized and dimensioned to fit within the hollow interior of the stem 18. The magnet 22 in the illustrated example embodiment fits within the hollow interior of the stem 18 in a frictional, press-fit arrangement. The magnet 22 is configured to completely fit within the hollow interior of the stem 18, such that no portion of the magnet is exposed from the stem. The magnet 22 is configured to communicate with a sensor, as described in more detail below. In another alternative example embodiment, the magnet 22 is positioned and held within the stem 18 of the actuator 12 by overmolding and/or heat staking, or some other means.

The housing assembly 14 includes a first housing member 24 and a second housing member 26. As described in more detail below, the first and second housing members 24 and 26 are configured to mate with one another. The first housing member 24 includes a main body 28 that defines an interior space 30. It will be appreciated that the interior space 30 is configured as a blind hole. The main body 28 is generally cylindrical, and is made of a metal (e.g., aluminum, stainless steel, etc.) or a non-metal (e.g., plastic). The main body 28 includes an upper portion 32 and a lower portion 34.

The upper portion 32 of the main body 28 includes a series of tabs 36 and recesses 38 that can be alternately arranged around the perimeter of the upper portion. That is, each tab 36 is bordered on each adjacent side thereof by a recess 38 such that the tabs do not border each other and the recesses do not border each other. The tabs 36 and the recesses 38 allow the first housing member 24 to engage a lid member 110, as described in more detail below.

The lower portion 34 of the main body 28 includes first and second deflectable wing members 40 and 42 and first and second slots 44 and 46 that are alternately arranged on opposing sides of the main body. That is, each wing member 40 and 42 is bordered on each side thereof by the first and second slots 44 and 46 such that the wing members do not border each other and the slots do not border each other on adjacent sides of the main body 28. The first and second wing members 40 and 42 are configured to engage a portion of the socket S of the lawn mower LM, and the first and second slots 44 and 46 are configured to engage first and second locking members 74 and 76 of the second housing member 26.

First and second engagement members 48 and 50 extend from the lower portion 34 below the wing members 40 and 42. That is, the first engagement member 48 is disposed below the first wing member 40, and the second engagement member 50 is disposed below the second wing member 42. The first and second engagement members 48 and 50 are configured to engage engagement slots 78 and 80 of the second housing member 26 to lock the first and second housing members 24 and 26.

A cylindrical tubular receiving member 52 is disposed within the interior space 30 of the main body 28. The receiving member 52 includes an opening 54 to receive and hold a support assembly 100 of the housing assembly 14. The receiving member 52 is fixed to a bottom surface 56 of the main body 28. The bottom surface 56 acts as a seal between the first and second housing members 24 and 26.

The main body 28 also includes first and second drain holes 58 and 60 that are disposed above the first and second slots 44 and 46. The first and second drain holes 58 and 60 are configured to evacuate water and debris that may enter into the interior space 30. It will be appreciated that the bottom surface 56 of the main body 28 is positioned such that the first and second drain holes 58 and 60 are disposed above the bottom surface 56 and the first and second slots 44 and 46 are disposed below the bottom surface 56. Thus, the first and second drain holes 58 and 60 are configured to evacuate water and debris from the interior space 30 to provide a seal between the first and second housing members 24 and 26.

The second housing member 26 includes a main body 62 that defines an interior space 64. The main body 62 is generally cylindrical, and is made of a metal (e.g., aluminum, stainless steel, etc.) or a non-metal (e.g., plastic). The main body 62 includes an upper portion 66 and a lower portion 68.

The upper portion 66 of the second housing member 26 is configured to be received by the lower portion 34 of the first housing member 24. The upper portion 66 includes a first lip 70 for supporting an O-ring seal 72 to provide a seal between the first and second housing members 24 and 26. The upper portion 66 also includes first and second locking members 74 and 76 that are oppositely disposed on the main body 62. The first and second locking members 74 and 76 are each configured to engage the first and second slots 44 and 46 of the first housing member 24 to lock the first and second housing members 24 and 26 together.

The upper portion 66 further includes first and second engagement slots 78 and 80 that are oppositely disposed on a second lip 82 of the upper portion 66. The first and second engagement slots 78 and 80 are configured to engage the first and second engagement members 48 and 50 of the first housing member 24 to lock the first and second housing members 24 and 26 together. The first and second locking members 74 and 76 and the first and second engagement slots 78 and 80 are alternately arranged around the upper portion 66 such that each locking member 74 and 76 is bordered on each adjacent side by one of the engagement slots 78 and 80.

The lower portion 68 of the main body 62 includes first and second notches 84 and 86 that are configured to engage a portion of the socket S of the lawn mower LM to install the switch assembly 10 in the lawn mower.

The second housing member 26 includes a terminal receiver 88 disposed in the interior space 64. The terminal receiver 88 includes one or more terminal receptacles 90 for receiving terminals of a printed circuit board (PCB) 94.

The housing assembly 14 further includes a circuit apparatus 92 disposed within the second housing member 26. The circuit apparatus 92 includes the PCB 94 and a sensor 96 disposed thereon. The circuit apparatus 92 is generally circular, and is sized and dimensioned to fit within the interior space 64 of the second housing member 26, which provides an isolated and environmental seal from debris and harsh operating environments. The variable output provides features that allow the switch assembly and particularly the PCB 94 to sense whether the actuator 12 is absent from the housing assembly 14, present within the housing assembly, and, if present, how it is positioned within the housing, e.g., being either depressed or at rest.

In the illustrated example embodiment, the sensor 96 is a Reed switch for communicating with the magnet 22 to operate the enablement switch assembly 10. The Reed switch 96 can vary an output voltage in the presence or absence of a magnetic field, and in this case formed by the presence of the actuator 12. Stated another way, the switch 96 detects the presence or absence of an external object (e.g., a switch, magnet, etc.). In the presence of a magnetic field, the switch 96 senses the magnetic field generated by the magnet 22, thereby allowing operation of the lawn mower LM. In the absence of a magnetic field, the switch 96 no longer senses the magnetic field, thereby preventing operation of the lawn mower LM. In one example embodiment, the switch 96 is used as a "kill switch," thereby selectively allowing operation of the lawn mower LM (or other piece of heavy equipment) by a user, and disabling the lawn mower upon its removal.

The PCB 94 includes a plurality of terminals 98 that correspond to the terminal receptacles 90 of the terminal receiver 88. The PCB 94 is configured to electrically communicate with circuitry (not shown) of the lawn mower LM connected by terminals (not shown) to a wiring harness (not shown) coupled to an electronic control unit (ECU) of a motor (not shown) of the lawn mower LM. Such electrical communication includes the alteration of the electrical states, thus allowing the enablement switch assembly 10 to control operation (such as ON/OFF control) of the lawn mower LM. In an alternative example embodiment, the switch assembly 10 and its PCB 94 may interface directly with the lawn mower LM engine, battery, relays, and the like to control the operation (such as ON/OFF control).

The housing assembly 14 further includes a support apparatus 100 that is disposed within the receiving member 52 of the first housing member 24. The support apparatus 100 includes a collar 102 and a biasing member 104. The collar 102 is cylindrical and includes an opening 106 to receive the stem 18 of the actuator 12 to connect the actuator 12 to the housing assembly 14. The collar 102 includes a hollow interior 108 that allows the collar to engage the biasing member 104. The biasing member 104 is configured to support the collar 102 and the actuator 12 when the actuator is installed in the housing assembly 14. As shown, the biasing member 104 is a coil spring; however, it will be appreciated the biasing member can include any mechanism suitable to position the collar 102.

Figure 24:
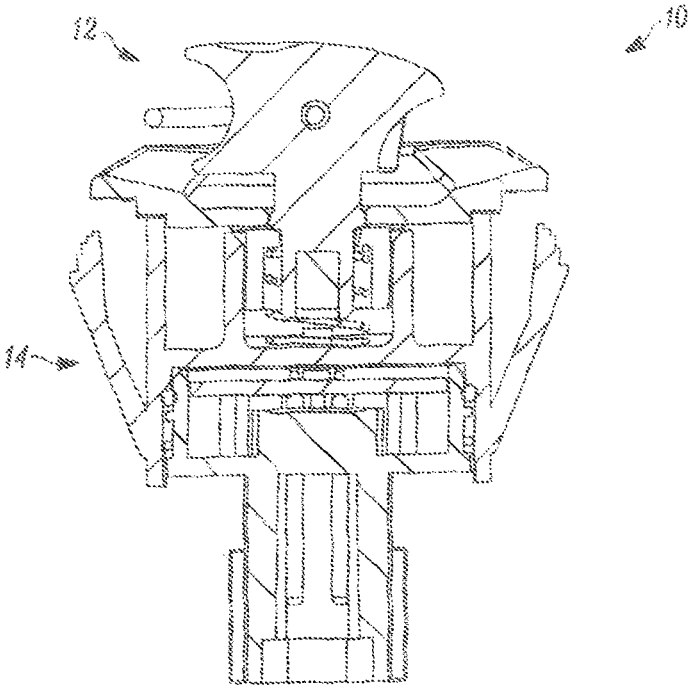
FIG. 24 is a section view illustrating an actuator located in a first position within a housing assembly.
Figure 25:
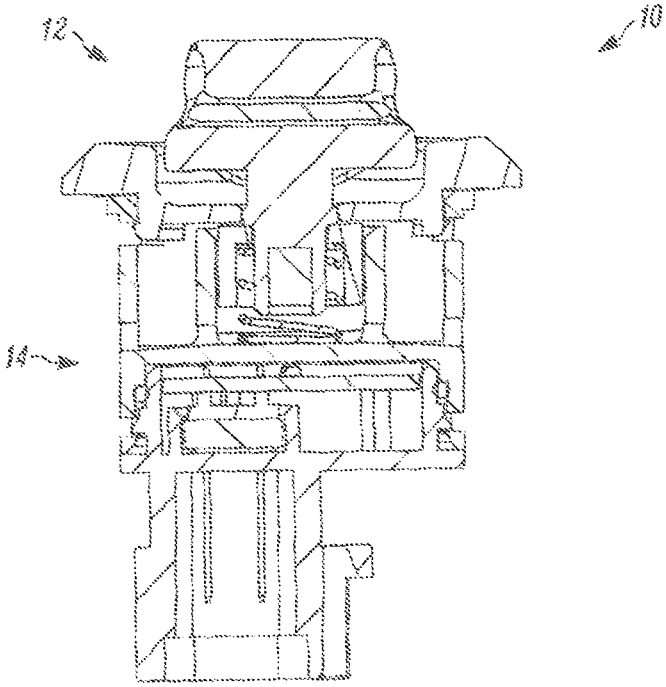
FIG. 25 is another section view illustrating an actuator located in a first position within a housing assembly.
Figure 26:
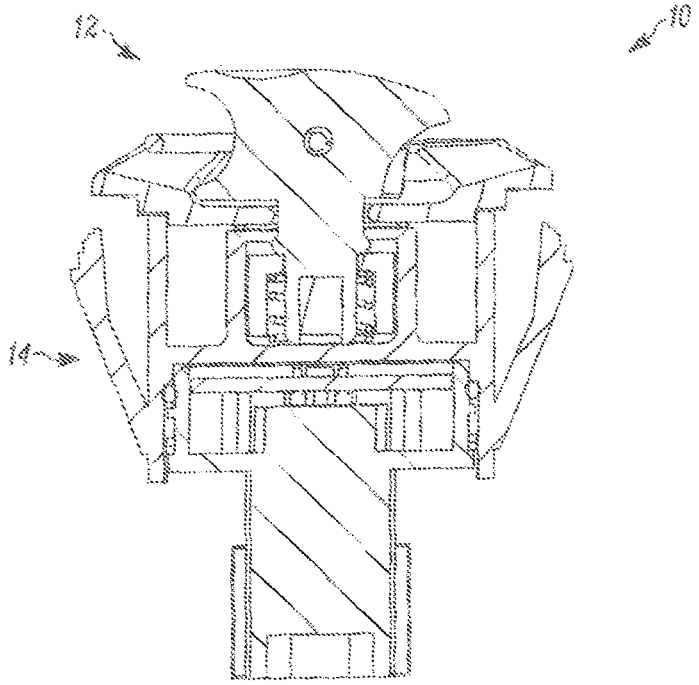
FIG. 26 is a section view illustrating an actuator located in a second position within a housing assembly.
Figure 27:
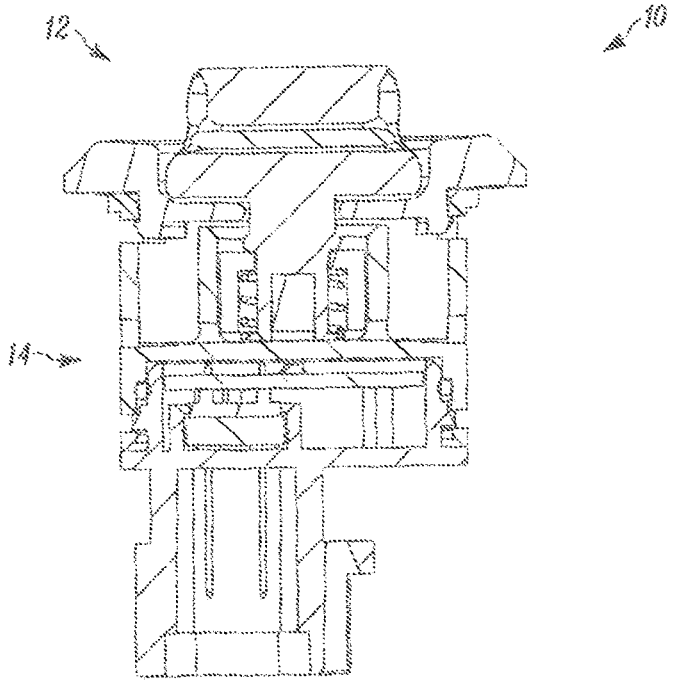
FIG. 27 is another section view illustrating an actuator located in a second position within a housing assembly.

The spring or biasing member 104 further advances the collar 102 against an annular ridge 81 until the ridges engage a detent 79 in a first or up position as illustrated in FIGS. 24 and 25 when the actuator is first inserted into the housing assembly 14. An additional down force advances the actuator to a second or down position as illustrated in FIGS. 26 and 27, as the ridges 81 pass beyond the detent 79.

The housing assembly 14 includes a lid member 110. The lid member 110 is generally circular, and is made of a metal (e.g., aluminum, stainless steel, etc.) or a non-metal (e.g., plastic). The lid member 110 retains the collar 102 and biasing member 104 within the housing assembly 14. The lid member 110 is also configured to provide ingress protection to the interior space 30 of the first housing member 24 and acts as an aesthetic trim piece. The lid member 110 includes a series of tabs (not shown) and recesses (not shown) that are configured to cooperate with the recesses 38 and the tabs 36, respectively of the first housing member 24. The lid member 110 also includes a central opening 112 that can be coaxially aligned with the opening 106 of the collar 102. The central opening 112 is configured to receive the stem 18 of the actuator 12 to connect the actuator 12 to the housing assembly 14. The lid member 110 also includes first and second flanges 114 and 116 that can be configured to engage third and fourth slots 118 and 120 of the first housing member 24 to connect the lid member 110 to the first housing member 24.

Figure 2:
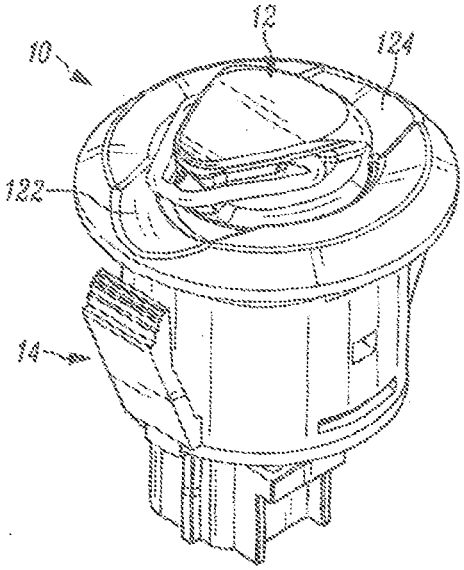
FIG. 2 is a first top perspective view of a switch assembly constructed in accordance with one example embodiment of the present disclosure.
Figure 3:
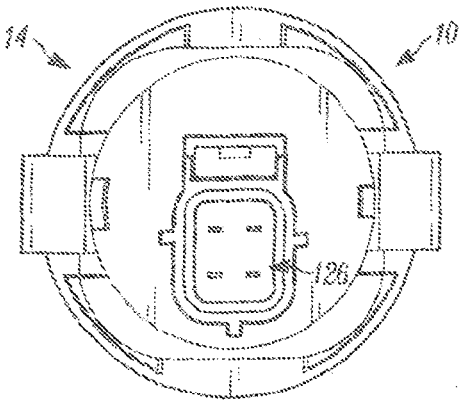
FIG. 3 is a bottom plan view of FIG. 2.
Figure 4:
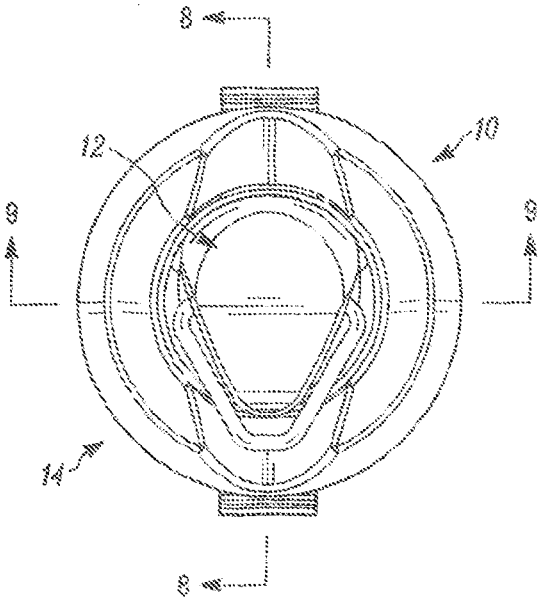
FIG. 4 is a top plan view of FIG. 2.
Figure 7:
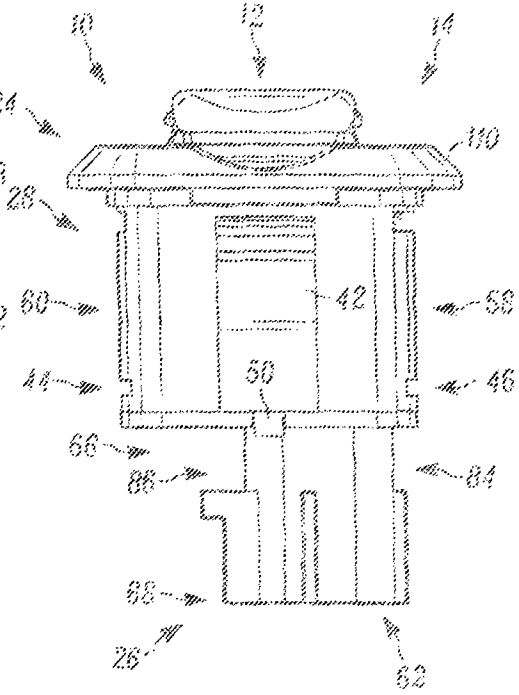
FIG. 7 is a rear elevation view of FIG. 5.
Figure 6:
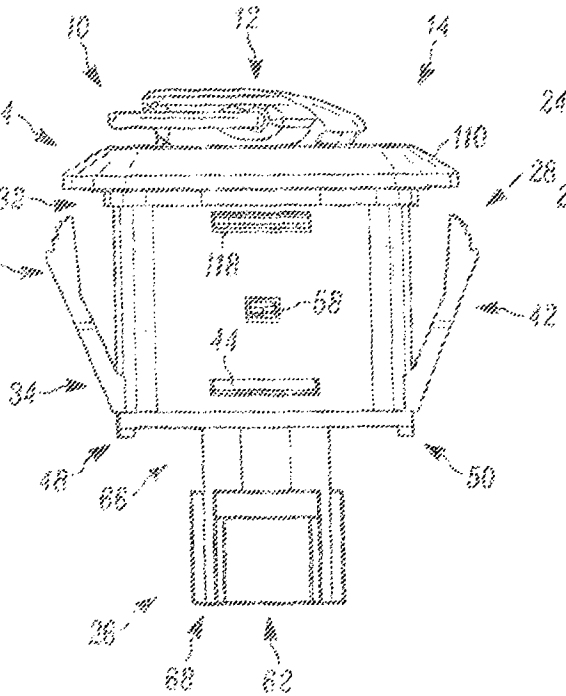
FIG. 6 is a side elevation view of FIG. 5.
Figure 5:
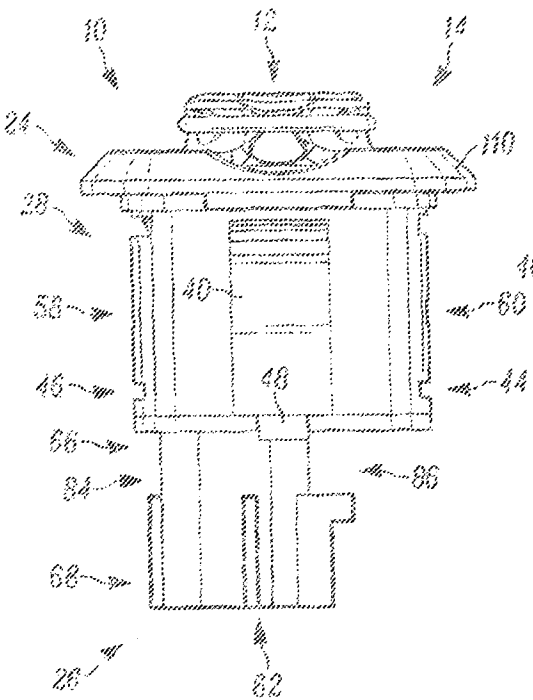
FIG. 5 is a front elevation view of FIG. 2.
Figure 8:
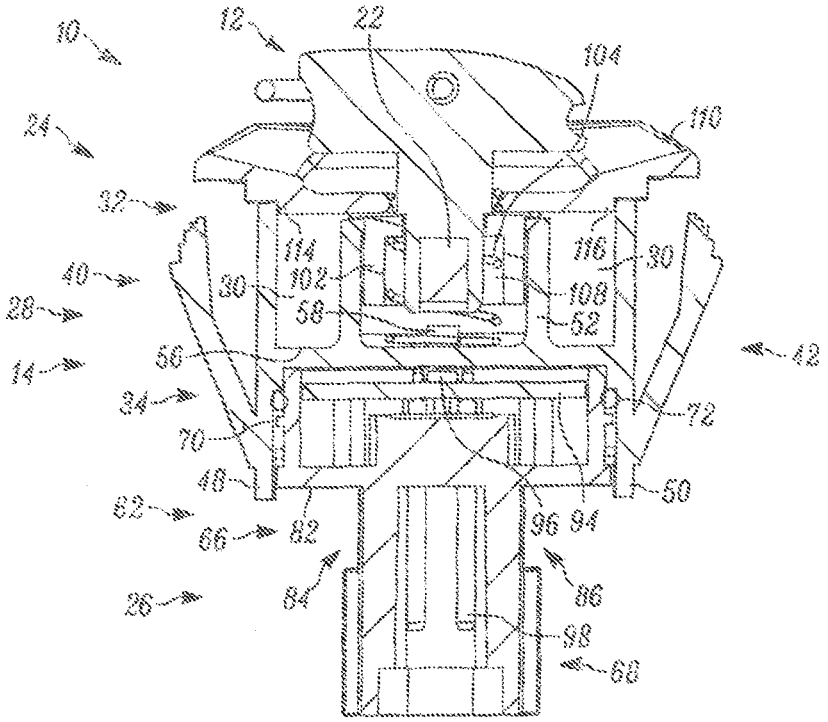
FIG. 8 is a side elevation section view along section lines 8-8 illustrated in FIG. 4.
Figure 9:
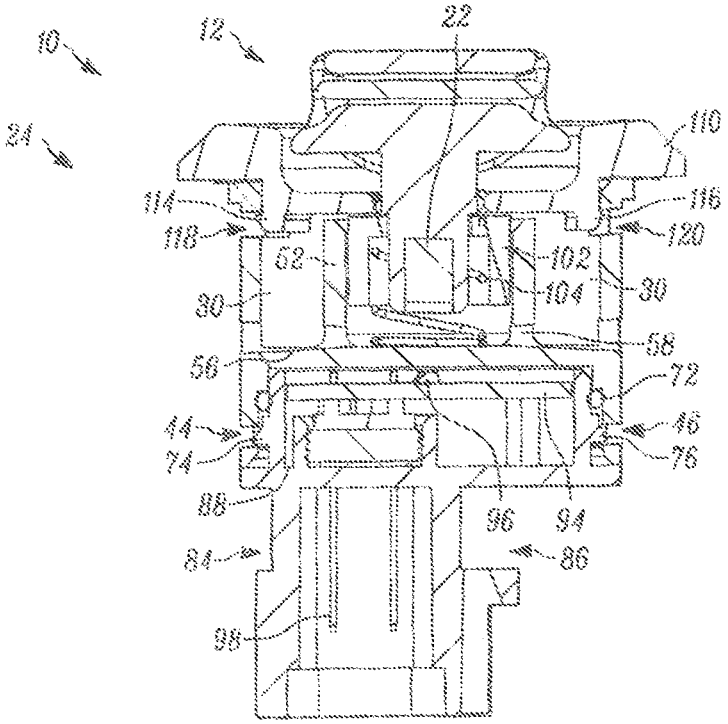
FIG. 9 is a front elevation section view along section lines 9-9 illustrated in FIG. 4.
Figure 10:
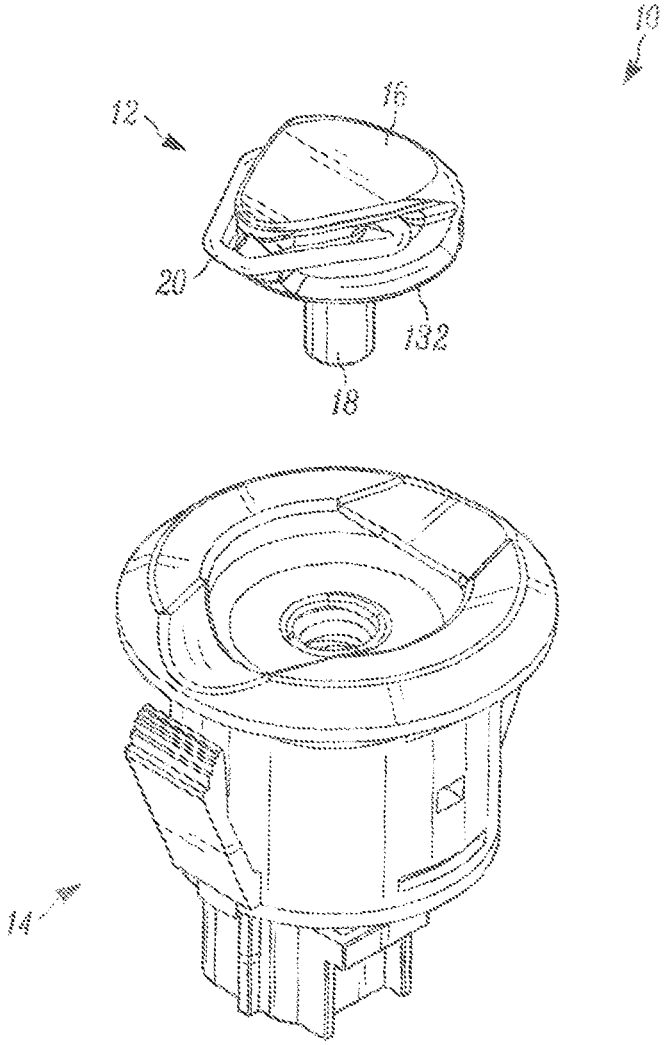
FIG. 10 is a disassembled view of the switch assembly of FIG. 2.
Figure 11:
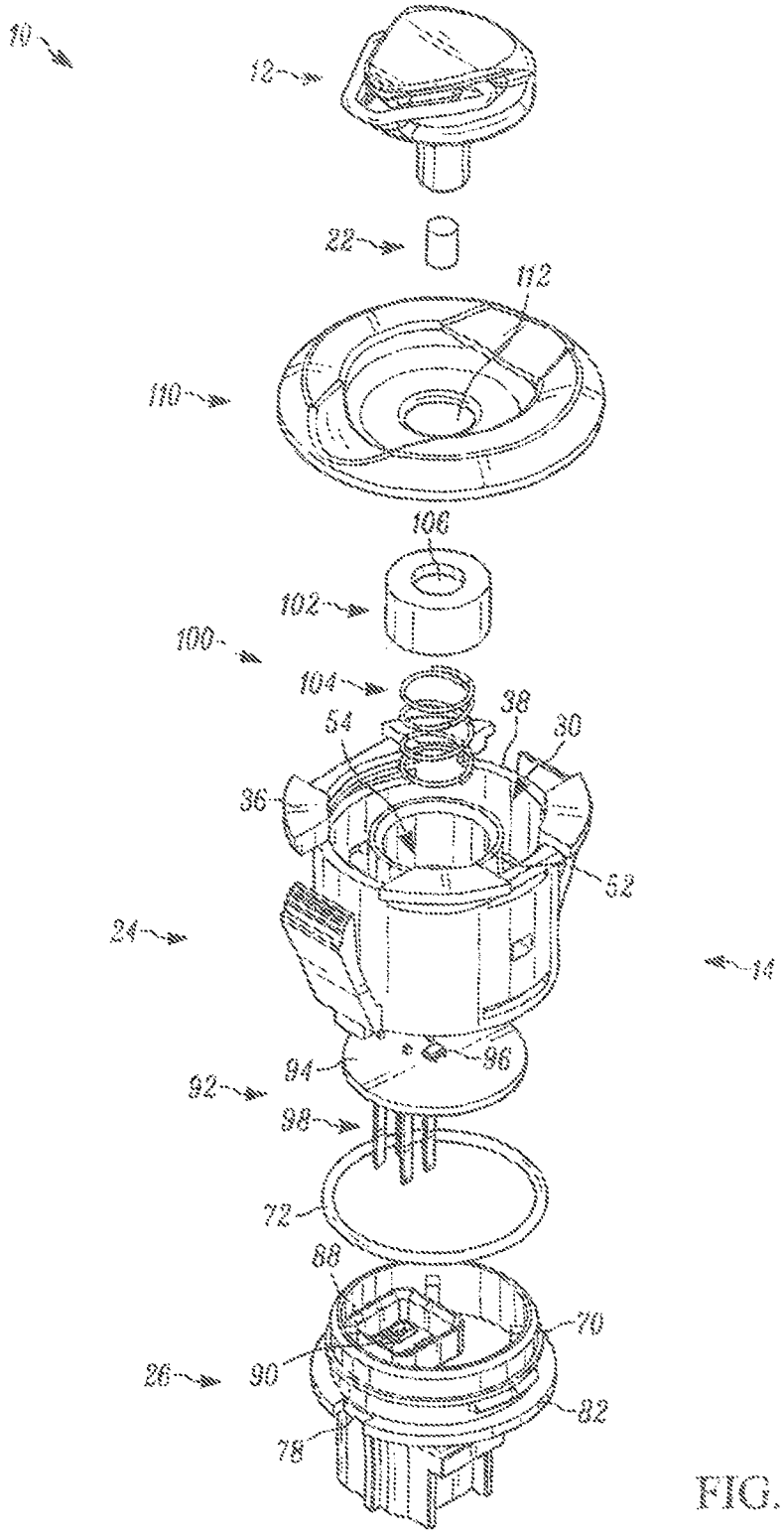
FIG. 11 is an exploded assembly view of FIG. 10.
Figure 12:
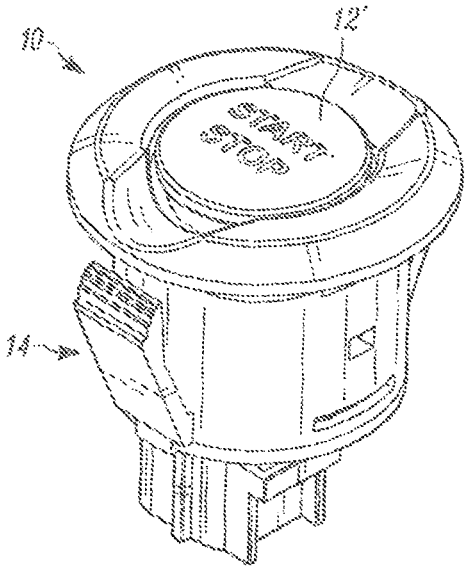
FIG. 12 is a second top perspective view of a switch assembly constructed in accordance with another example embodiment of the present disclosure.
Figure 13:
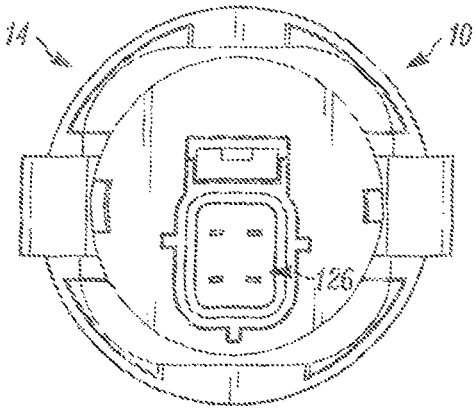
FIG. 13 is a bottom plan view of FIG. 12.
Figure 14:
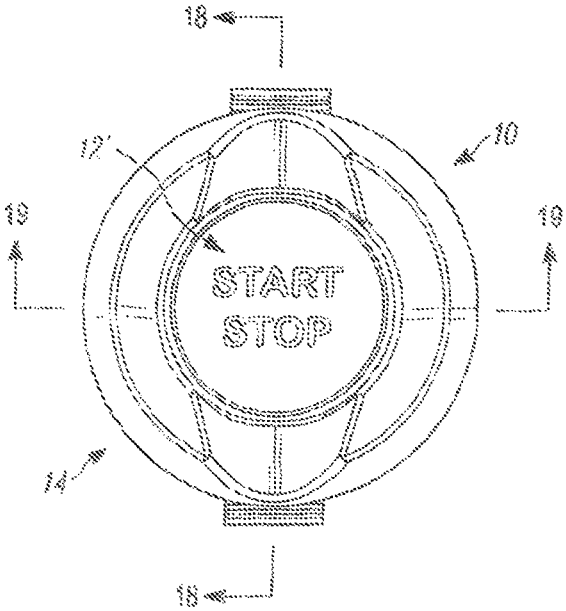
FIG. 14 is a second top plan view of FIG. 12.
Figure 17:
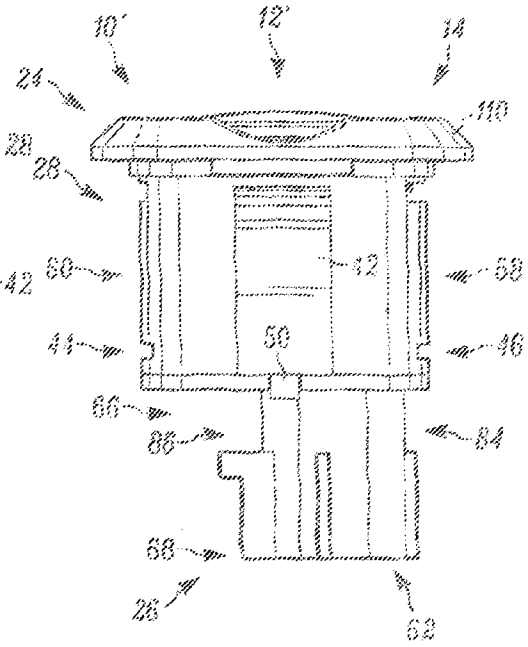
FIG. 17 is a rear elevation view of FIG. 15.
Figure 16:
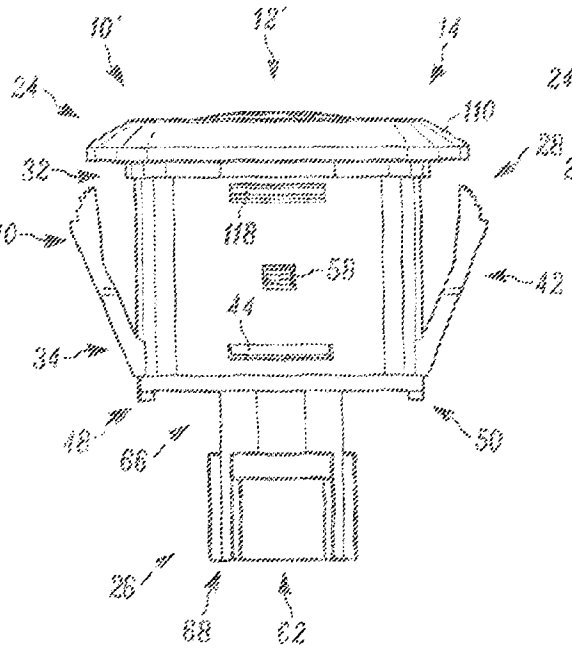
FIG. 16 is a side elevation view of FIG. 15.
Figure 15:
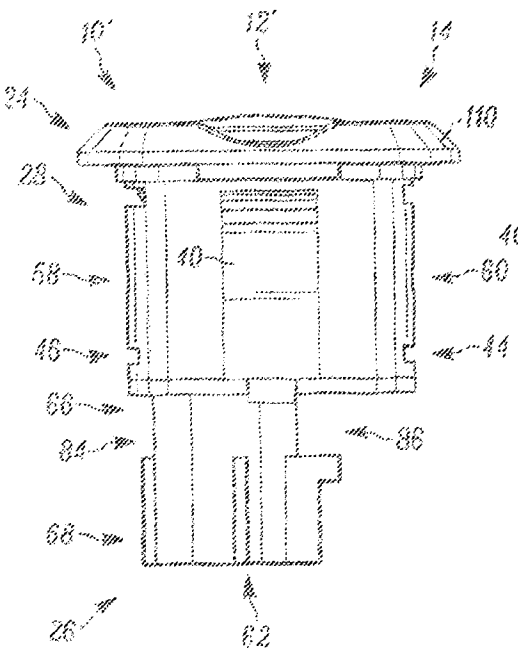
FIG. 15 is a front elevation view of FIG. 12.
Figure 18:
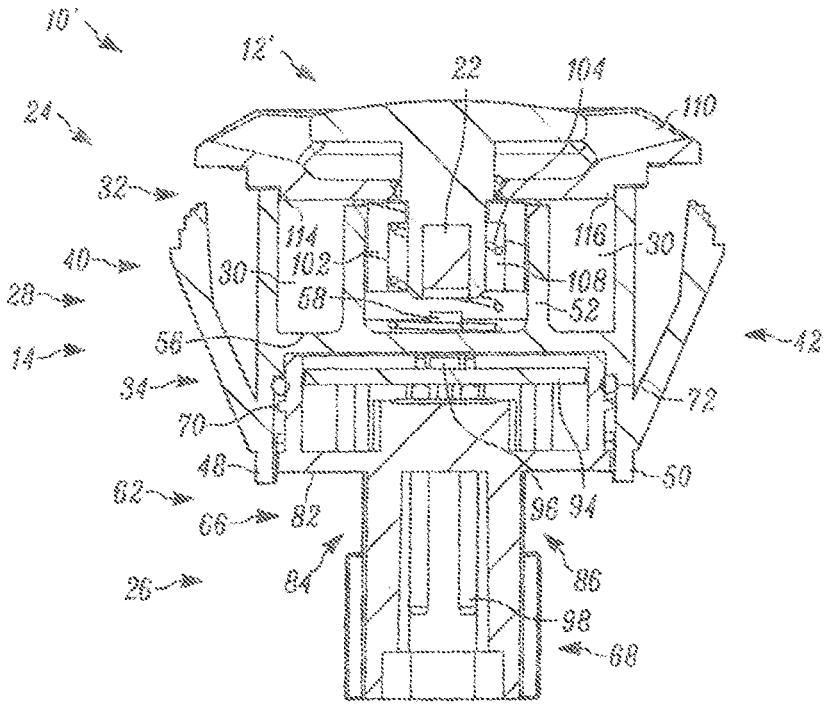
FIG. 18 is a side elevation section view along section lines 18-18 illustrated in FIG. 14.
Figure 19:
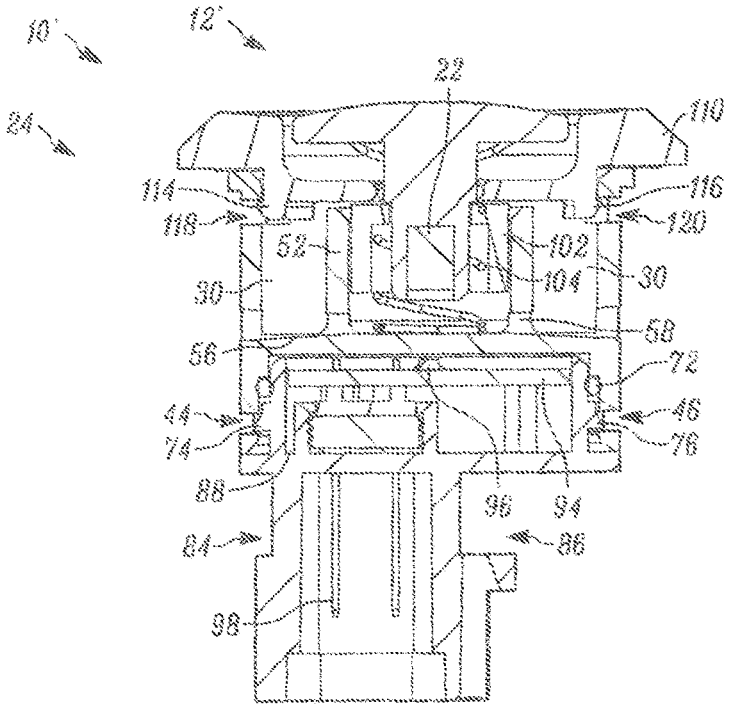
FIG. 19 is a front elevation section view along section lines 19-19 illustrated in FIG. 14.
Figure 20:
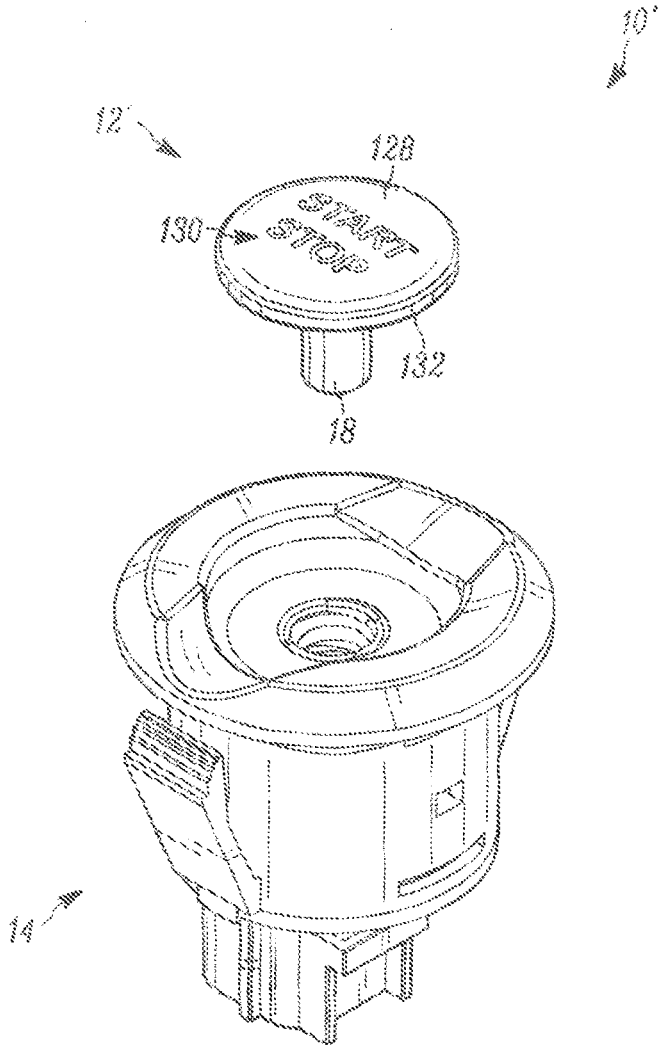
FIG. 20 is a disassembled view of the switch assembly of FIG. 12.
Figure 21:
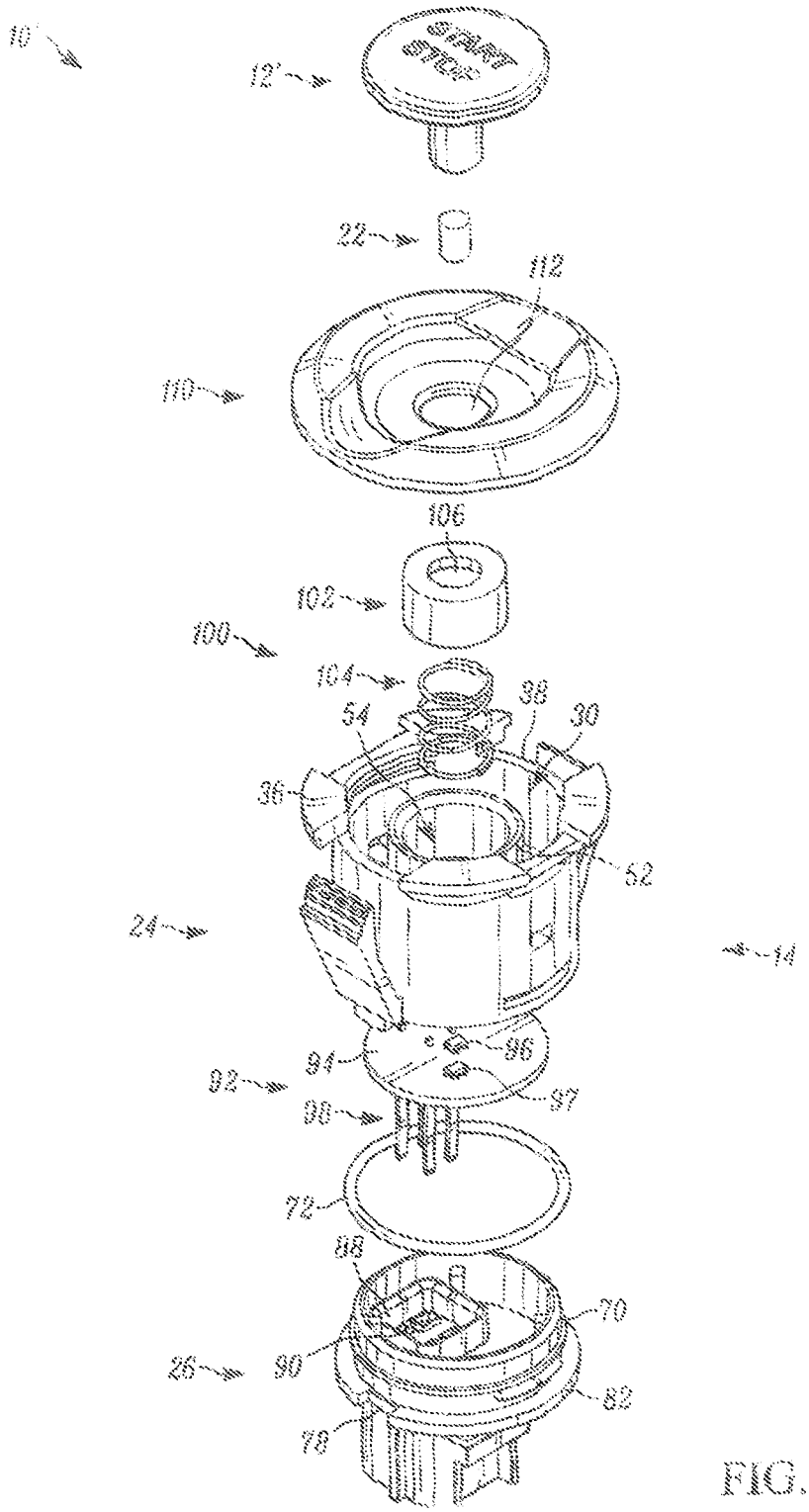
FIG. 21 is an exploded assembly view of FIG. 20.
Figure 22:
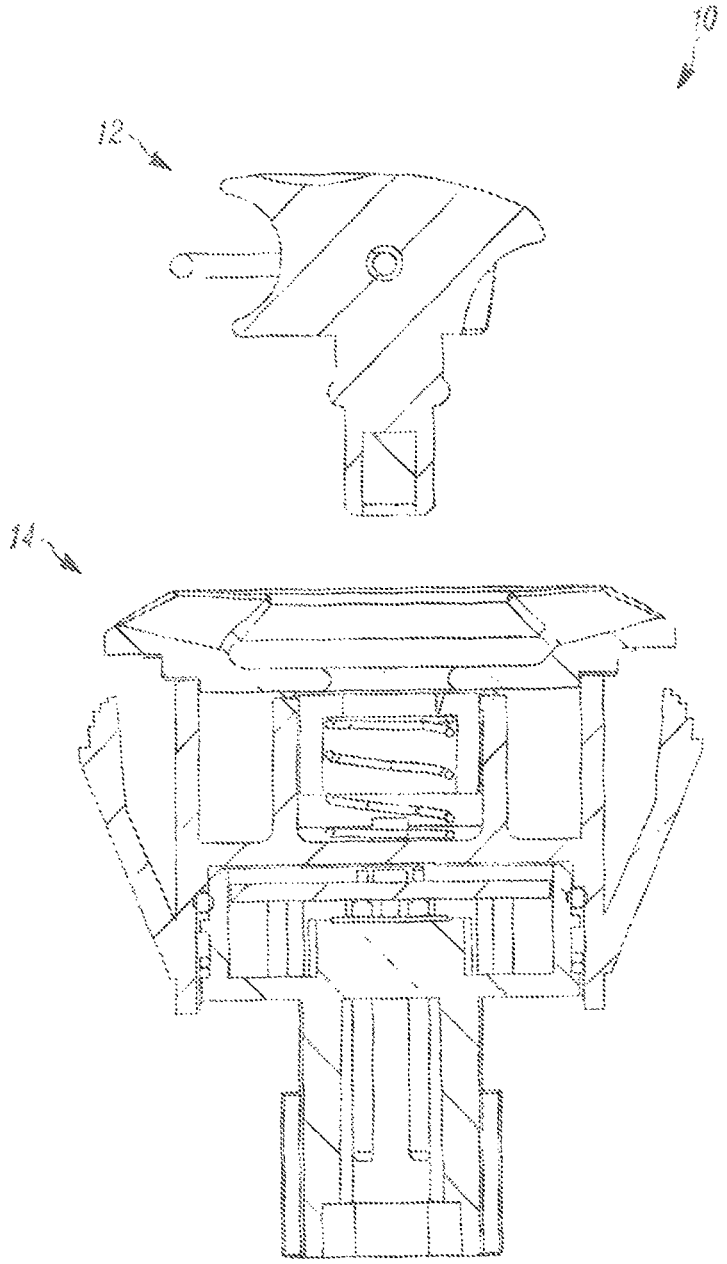
FIG. 22 is an exploded section view illustrating an actuator removed from a housing assembly.
Figure 23:
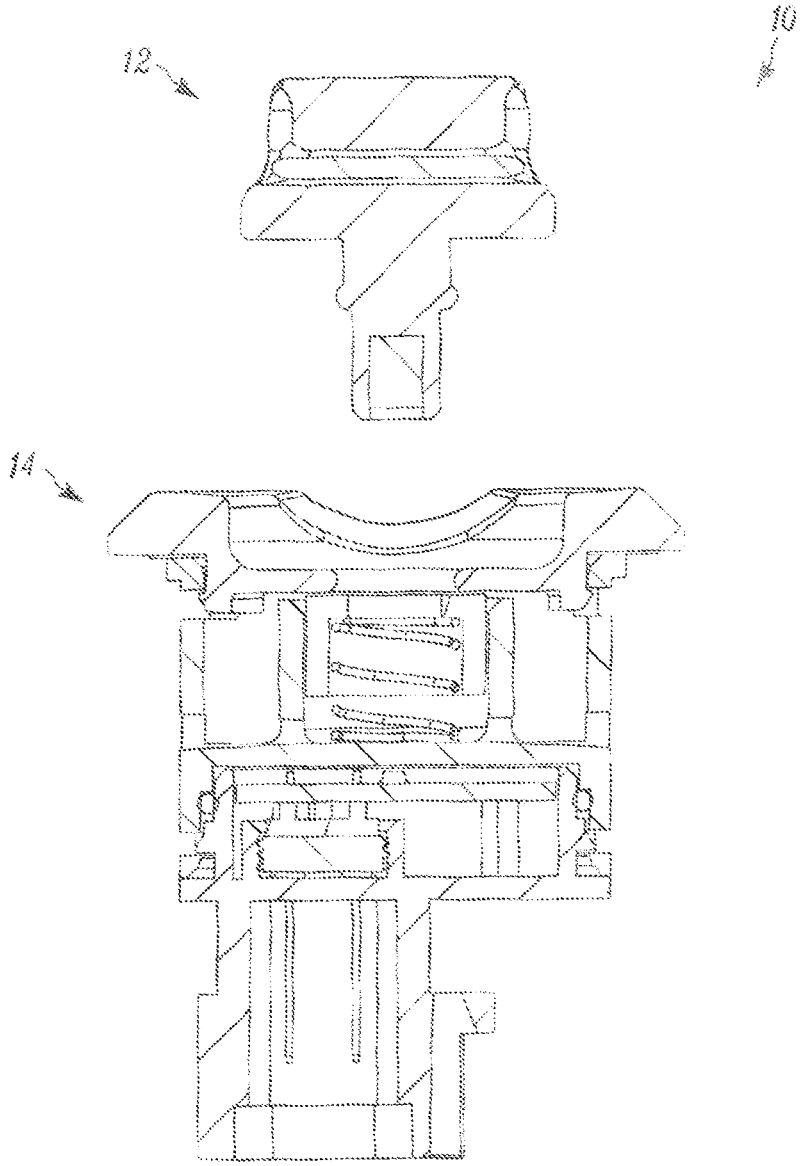
FIG. 23 is another exploded section view illustrating an actuator removed from a housing assembly.

The lid member 110 further includes first and second concave receiving surfaces 122 and 124, as best seen in FIG. 2. The first and second receiving surfaces 122 and 124 are configured to provide a space for the fingers of a user to easily remove the actuator 12 from the housing assembly 14 to prevent operation of the lawn mower LM.

The switch assembly 10 is assembled before insertion into the socket S of the lawn mower LM. The O-ring seal 72 is positioned on the first lip 70 of the second housing member 26. The circuit apparatus 92 is installed into the interior space 64 of the second housing member 26 by inserting the plurality of terminals 98 into the corresponding plurality of terminal receptacles 90 of the terminal receiver 88. The terminal 98 fits snugly into the terminal receptacles 90 to prevent disengagement of the circuit apparatus 92 from the terminal receiver 88. It will be appreciated that the circuit apparatus 92 can be installed into the terminal receiver 88 before the O-ring seal 72 is positioned on the first lip 70.

Once the circuit apparatus 92 and the O-ring seal 72 are positioned, the first housing member 24 is connected to the second housing member 26. The second housing member 26 is inserted into the first housing member 24 such that the lower portion 34 of the first housing member 24 receives the upper portion 66 of the second housing member 26. The first and second slots 44 and 46 of the first housing member 24 and the first and second locking members 74 and 76 of the second housing member are aligned with one another. Consequently, the first and second engagement members 48 and 50 of the first housing member and the first and second engagement slots 78 and 80 of the second housing member are aligned with one another. The upper portion 66 of the second housing member 26 is inserted into the lower portion 34 of the first housing member until the first and second locking members 74 and 76 engage the first and second slots 44 and 46 in a snap-fit configuration. Consequently, the first and second engagement members 48 and 50 are engaged with the first and second engagement slots 78 and 80 in a snap-fit configuration.

When the first and second housing members 24 and 26 are engaged with one another, the circuit apparatus 92 is disposed between the O-ring seal 72 and the bottom surface 54 of the first housing member. The bottom surface 54 seals the circuit apparatus 92 from debris and/or water that enters the interior space 30 of the first housing member 24. The O-ring seal 72 seals the circuit apparatus 92 from debris and/or water that enters the space between the now-engaged first and second housing members 24 and 26. Thus, the circuit apparatus 92 is completely sealed from any water and/or debris that enters the housing assembly 14.

The support apparatus 100 is installed after the first and second housing members 24 and 26 are engaged with one another. The biasing member 104 is inserted into the opening 54 of the receiving member 52 of the first housing member 24. The collar 102 is then inserted into the opening 54 of the receiving member 52 such that the collar rests on top of the biasing member 104. The biasing member 104 fits within the hollow space 108 of the collar 102, thereby allowing the biasing member 104 to bias the collar 102 upward.

To complete assembly of the housing assembly 14, the lid member 110 is installed onto the first housing member 24. The recesses (not shown) and the tabs (not shown) of the lid member 110 are engaged with the tabs 36 and the recesses 38, respectively, of the upper portion 32 of the first housing member 24. The first and second flanges 114 and 116 of the lid member 110 and the third and fourth slots 118 and 120 of the first housing member 24 are engaged with one another to lock the lid member to the first housing member. Once the lid member 110 is installed, the central opening 112 is aligned with the opening 106 of the collar 102. It will be appreciated that the support apparatus 100 and the lid member 110 can be engaged with the first housing member 24 before the first housing member is engaged with the second housing member 26.

Once the housing assembly 14 is assembled, the actuator 12 is engaged with the housing assembly to complete assembly of the switch assembly 10. The stem 18 of the actuator 12 is inserted into the aligned central opening 112 of the lid member 110 and the opening 54 of the collar 102. As shown, the stem 18 is surrounded by one or more portions of the biasing member 104. The housing 16 of the actuator 12 rests on the collar 102 to overcome the bias of the biasing member 104, thereby securing the actuator 12 within the housing assembly 14.

Now assembled, the switch assembly 10 is inserted into the socket S of the lawn mower LM. The lower portion 68 of the second housing member 26 is first inserted into the socket S. As the switch assembly 10 is inserted into the socket S, the first and second wing members 40 and 42 are deflected inward to allow the switch assembly to further pass into the socket. The first and second wing members 40 and 42 are deflected outward into corresponding recesses (not shown) when the lid member 110 is flush with a portion of an outer body of the lawn mower LM. The lower portion 68 of the second housing member includes a socket 126 configured to engage a portion of circuitry (not shown) of the lawn mower LM.

As noted, the switch 96 can be configured as a Reed switch. However, it will be appreciated that the switch 96 can be another technology, including but not limited to, infrared, capacitive, or inductive sensing, where the magnet 22 would be replaced with a different device such as metal, sensor, or light to accommodate the different types of engagement from the switch 96, as would be appreciated by those skilled in the art.

Returning to the illustrated example embodiment, once the actuator 12 is inserted into the first position of the housing assembly 14 (see FIGS. 24 and 25). The switch 96 senses the magnetic field supplied by the magnet 22 such that the output voltage of the switch 96 is increased, thereby causing the PCB 94 to be enabled communicate with the wiring harness (not shown) of the lawn mower LM. A second switch 97 is enabled when the actuator 12 is advanced to the second position in the housing, as illustrated in FIGS. 26 and 27. This second position 97 when enabled initiates the process of starting the starter solenoid and engine. Thus, operation of the lawn mower LM is commenced. The second switch 97 in one example embodiment is a mechanical switch, such as a contact switch or plunger switch. While it should be appreciated that the second switch 97 could also be a Reed switch, inductance switch, phototransistor switch, Hall effect sensor, and the like.

When the actuator 12 is removed from the housing assembly 14, the switch 96 is no longer influenced by the magnetic field supplied by the magnet 22. The output voltage through the switch 96 is cut off, thereby causing the PCB 94 to communicate with the wiring harness (not shown) of the lawn mower LM to ground the magneto of the engine, thus, halting its operation to an OFF or disabled state. In an alternative example embodiment of a non-gas powered engine or electric motor the removal of the actuator 12 will reduce the power supplied to the LM motor. Thus, operation of the lawn mower LM is rendered impossible, thereby allowing the actuator 12 to act as a "kill switch."

FIGS. 6-10 illustrate an enablement switch assembly 10' constructed in accordance with another example embodiment of the present disclosure. The enablement switch assembly 10' is configured similarly to the switch assembly 10 of FIGS. 1-5, except as described below. The enablement switch assembly 10' includes an actuator 12' for use with the housing assembly 14 of FIGS. 1-5.

The actuator 12' is selectively removable from the housing assembly 14. The actuator 12' includes the stem 18 of the actuator 12; however, the housing 16 and the handle 20 are replaced with a housing 16'. The housing 16' is generally circular. The housing 16' is made of a metal (e.g., aluminum, stainless steel, etc.) or a non-metal (e.g., plastic). The housing 16' includes a flat top surface 128 with an display 130 disposed thereon. The display 130 includes a "START" insignia and a "STOP" insignia, however it should be appreciated that other text and/or symbology could be used without departing from the spirit and scope of the present disclosure.

The actuator 12' can be used as an ignition kill switch to operate the lawn mower LM. In addition, the actuator 12' can be used to alter the state or operation of the lawn mower LM based on its position within the housing assembly 14 based on the magnetic field supplied by the magnet 22 because of its proximity to the switch 96. For example, in one example embodiment, the actuator 12 is inserted into the housing assembly 14, the lawn mower LM will enable accessory power output(s), and a second insertion or push of the actuator 12 deeper within the housing assembly results in the enablement of an output to turn on a starter solenoid for enabling the lawn mower engine. Under such operation, the switch 96 detects the presence of the actuator 12, and the microcontroller can sense further advancement of the actuator's position. Thus, the actuator 12 operates similar to a control switch having an up and momentary down positions, resulting in different outputs and control of the lawn mower LM. Stated another way, the switch 96 permits different outputs to the lawn mower LM based on the position of the actuator 12 within the housing assembly 14 from for example a first position illustrated in FIGS. 24 and 25 to a second position illustrated in FIGS. 26 and 27.

When the actuator 12' is removed from the housing assembly 14, the switch 96 no longer senses the magnetic field supplied by the magnet 22. The output voltage through the switch 96 is cut off thereby causing the PCB 94 to communicate with the wiring harness (not shown) of the lawn mower LM to ground the magneto, thus shutting down the engine. Thus, operation of the lawn mower LM is rendered impossible. In this manner, the actuator 12' acts as a "kill switch."

Figure 28:
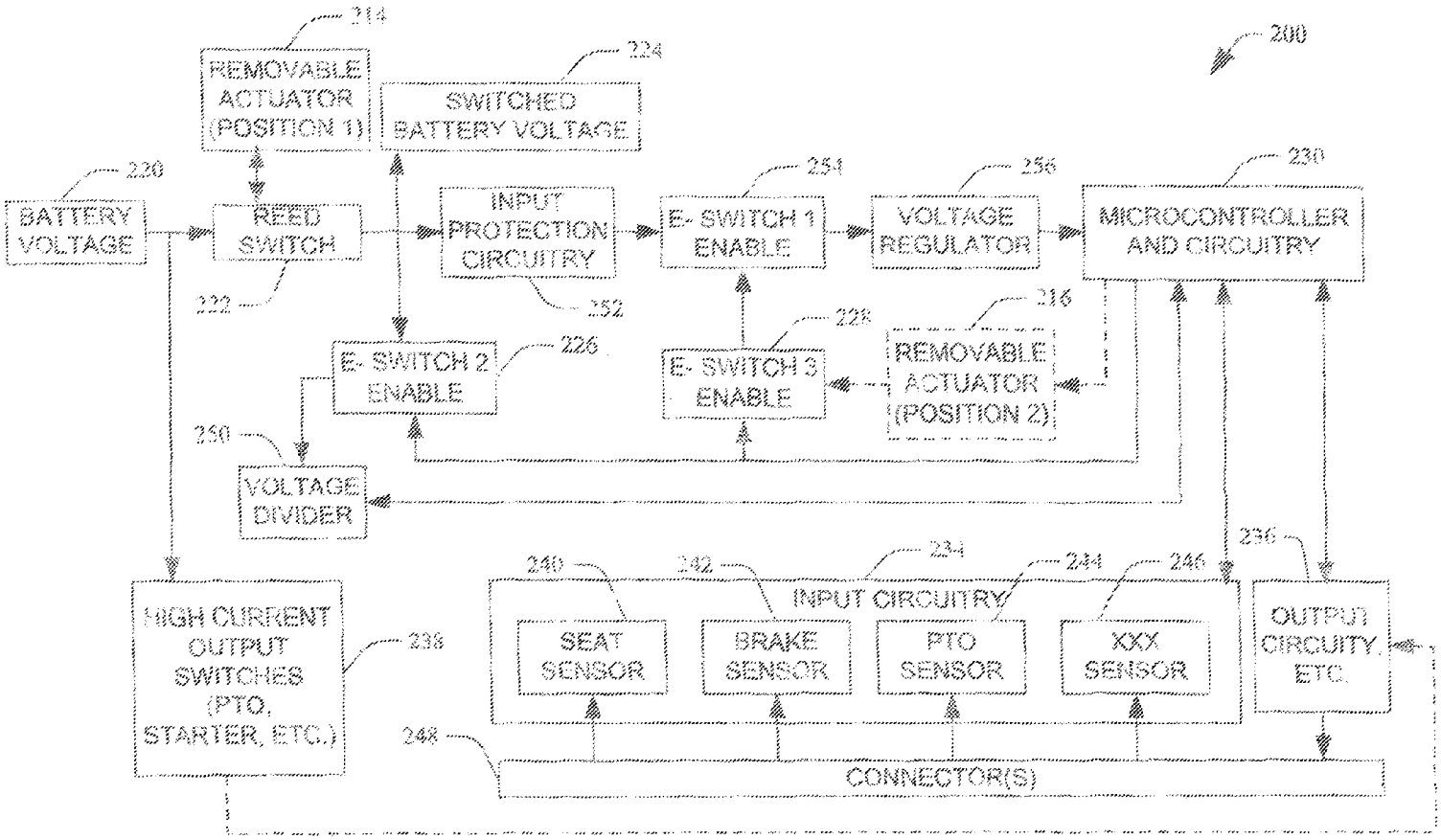
FIG. 28 depicts a schematic of circuitry for operating a switch assembly in accordance with one example embodiment of the present disclosure.

Illustrated in FIG. 28 is another example embodiment comprising an exemplary circuit 200 used in the operation of the switch assembly 10 employing a removable actuator, which can correspond to removable actuator 12 and 12', as described with respect to FIGS. 1-27. FIG. 28 depicts that the removable actuator can be inserted into a housing assembly configured for application of the removable actuator in a first 214 and a second 216 position. The housing assembly can correspond to housing assembly 14 and 14', as described with respect to FIGS. 1-27. Thus, different control outputs can be provided based on the relative positions 214 and 216 of the removable actuator.

For example, upon activating first switch 222, e.g., a Reed switch, current will flow from power supply 220 through a power supply protection component 252 to supply power to a first electronic switch 254 and a regulator circuit 256. At this stage, no current is supplied to the microcontroller 230 from the regulator circuit 256. Additionally, a voltage divider 250 is activated to monitor current from power supply 220. For example, a second electronic switch 226 connecting voltage divider 250 to the microcontroller 230 is typically open. When current is supplied to the microcontroller 230 and the power equipment is in operation, the second electronic switch 226 is engaged and power is directly applied to the voltage divider 250. When the voltage divider 250 is disabled, the current from the power supply 220 can be cut off, preventing possible current flow when the microcontroller 230 is not operating.

The removable actuator can be further inserted into the housing to occupy second position 216 corresponding to the second position in the housing. Thus, the removable actuator can be forced into the second position and initiate operation of the equipment by activating, e.g., a mechanical switch. This action would further activate second electronic switch 226 and third electronic switch 228, allowing another control signal to flow to the microcontroller 230. The control signal can instruct the microcontroller 230 to activate. At this stage, firmware and/or hardware within microcontroller 230 will become enabled and communicate with regulator circuit 256 with instructions to supply engine operating current.

Moreover, the microcontroller 230 is connected to input circuitry 234 corresponding to a variety of operating conditions that indicate the equipment can be safely operated. For example, the input circuitry 234 can include a seat sensor 240, a brake sensor 242, a gear sensor 244, and other sensors 246 useful or necessary for the operation of a particular equipment platform. In this example, the seat sensor 240 may indicate the seat is unoccupied, the brake sensor 242 may indicate the brake is not engaged, and the gear sensor 244 may indicate the tractor is in reverse. The status of the various inputs are compared against a set of predetermined thresholds that must be complied with before the microcontroller 230 is able to activate output circuitry 236. Thus, if one or more of the sensors indicate that a predetermined status threshold is not met, the microcontroller 230 will not send the control signal to the starter. If the sensors do indicate that each status condition is met, the microcontroller 230 continues to monitor the input circuitry 234 to ensure that safe operation continues. Thus, even during full operation of the equipment, if the input circuitry 234 supplies an updated signal to the microcontroller 230 indicating a predetermined status condition is not met, the microcontroller 230 can disable the engine and other operational components of the tractor. Upon a determination that the conditions for operation have been met, however, the microcontroller 230 enables output circuitry 236 to activate, for example, a solenoid starter to power up an engine of the tractor as illustrated in FIG. 1. Moreover, output circuitry 236 remains in communication with input circuitry 234 by one or more connectors 248. Further, once activated, high current output 238 is supplied from the battery voltage 220 directly to, e.g., the solenoid starter. Thus, the engine and other components of the equipment will remain in operation, so long as the status conditions are met and the removable actuator is maintained in the second position.

Figure 29:
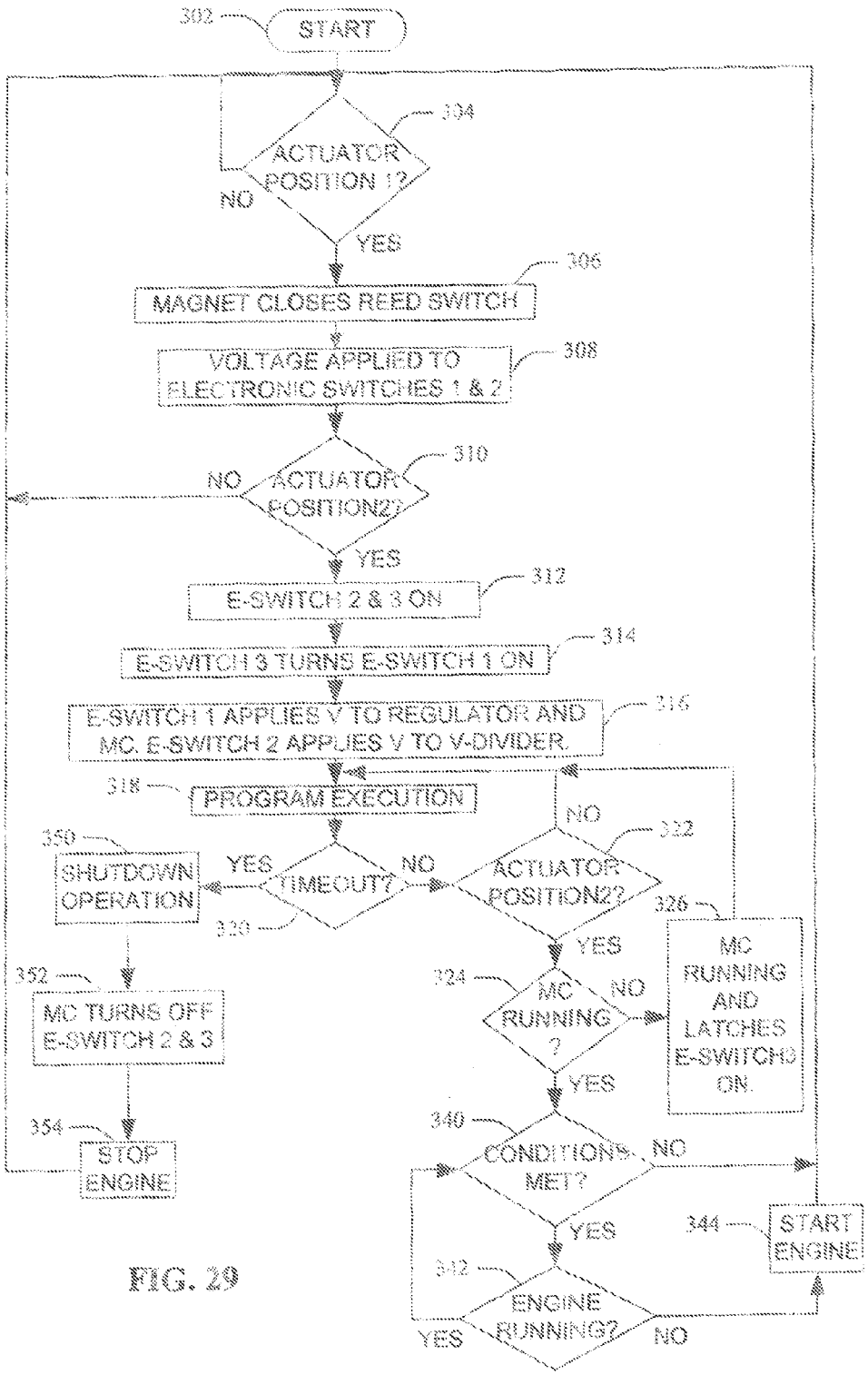
FIG. 29 is a flow chart that illustrates operation of a switch assembly in accordance with one example embodiment of the present disclosure.

FIG. 29 is a flow chart that illustrates operation of a switch assembly employing a removable actuator, as described with respect to FIGS. 1-28. At the start position 302, the removable actuator has been removed from the switch assembly housing, the switch has not been activated, and the electrical and other components of the equipment are disabled. The actuator is then inserted into the housing at a first position 304. At step 306, the Reed switch is closed by the influence of the actuator, and current is supplied to downstream system switches at step 308. For example, the system switches can include first electronic switch 254 and second electronic switch 226, supplying power to regulator circuit 256 and voltage divider 250, respectively, as provided in FIG. 28. At this point, no current is provided to the microcontroller.

At step 310 the actuator is further inserted into the housing assembly. If the actuator is not recognized, the process returns to the start position. If the actuator is recognized by, for example, engaging a mechanical switch by inserting the actuator into the second position, the process advances to step 312 where electronic switches 228 and 226 are activated. At step 314, electronic switch 228 fully activates electronic switch 254, thereby applying voltage at step 316 to voltage regulator 256 and microcontroller 230.

Moreover, electronic switch 226 is further activated to provide voltage to voltage divider 250.

Once the electronic switches are activated, the microcontroller initiates normal program execution at step 318 by initiating one or more of firmware, software, or other instructions. During normal operations, the microcontroller monitors the time at step 320. The timer ensures that circuitry, such as input circuitry 234, that has been activated by the actuator in the second position (310) does not continue to receive voltage in the absence of full platform operation, e.g., of a lawn mower. In other words, once the actuator is recognized as being in a second position, the timer begins. If the equipment is not fully functioning within a predetermined amount of time ("timeout"), the microcontroller can initiate shutdown operations at step 350. Thus, the microcontroller deactivates electronic switches 226 and 228, as well as stop the engine and associated components. Alternatively, if the actuator is not in the second position, such as having been removed from the housing, the microcontroller retains a limited use of power for a brief period of time to facilitate shutdown operations. For example, the microcontroller can save data from the previous operating period to a storage medium, including but not limited to, fuel consumption and hours of operation.

If the timeout has not passed, the microcontroller monitors the actuator position 322, and ensures the microcontroller is running properly at step 324. At step 340, the microcontroller monitors conditional information from one or more sensors of the input circuitry 234 to ensure a set of predetermined conditions are met. For example, the input conditions could include seat sensor 240, brake sensor 242, and gear sensor 244 of FIG. 28. If the microcontroller determines that the input conditions fail to meet one or more predetermined status conditions, the method does not advance and returns to the start 302 until each required status is achieved. For example, the microcontroller can send a signal to turn off the engine and/or remove power from electrical and mechanical components. It is to be understood that an operator may add or remove various status conditions, or change the parameters and/or threshold of each predetermined status, depending on the specific device or operating circumstances. If the operating conditions are satisfied, the microcontroller determines whether or not the engine is running at step 342. If all conditions are met, the engine is started 344, and the microcontroller continues to monitor the various conditions during operation of the equipment. Thus, the engine and other components of the equipment will remain in operation, so long as the status conditions are met and the removable actuator is maintained in the second position.

Figure 30:
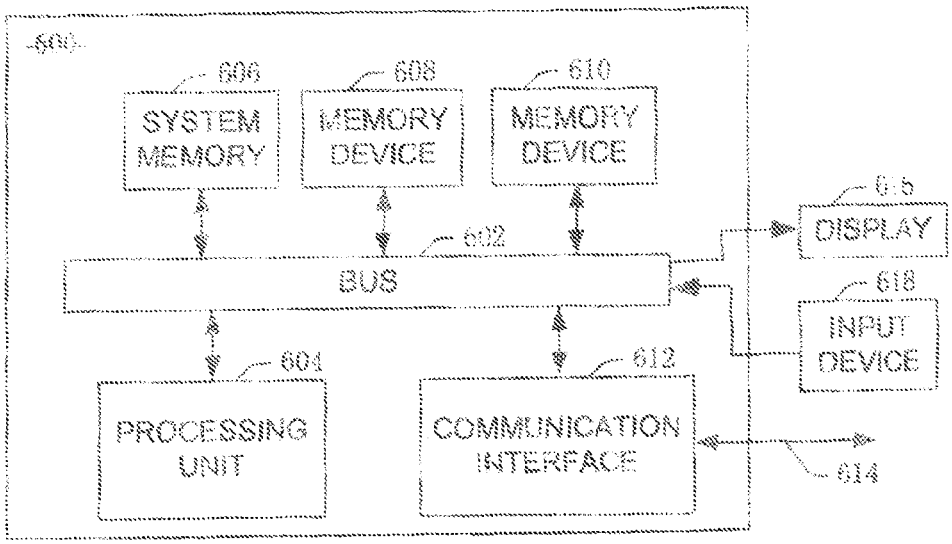
FIG. 30 is a schematic block diagram illustrating an exemplary system of hardware components capable of implementing examples of the systems and methods disclosed in FIGS. 1-29.

FIG. 30 is a schematic block diagram illustrating an exemplary system 600 of hardware components capable of implementing examples of the switch assembly 10 illustrated in FIGS. 1-29. The system 600 can include various systems and subsystems. The system 600 can be, for example, a personal computer, a laptop computer, a tablet computer, a smart portable device, a workstation, a computer system, an appliance, an application-specific integrated circuit (ASIC), a server, a server blade center, a server farm, or a similar device.

The system 600 can include a system bus 602, a processing unit 604, such as a microprocessor as described herein, a system memory 606, memory devices 608 and 610, a communication interface 612 (e.g., a network interface), a communication link 614, a display 616 (e.g., a video screen), and an input device 618 (e.g., a keyboard and/or a mouse). The system bus 602 can be in communication with the processing unit 604 and the system memory 606. The additional memory devices 608 and 610, such as a hard disk drive, server, stand alone database, or other non-volatile memory, can also be in communication with the system bus 602. The system bus 602 interconnects the processing unit 604, the memory devices 606-610, the communication interface 612, the display 616, and the input device 618. In some examples, the system bus 602 also interconnects an additional port (not shown), such as a universal serial bus (USB) port. The processing unit 604 can be a computing device and can include an application-specific integrated circuit (ASIC). The processing unit 604 executes a set of instructions to implement the operations of examples disclosed herein. The processing unit 604 can include a processing core.

The additional memory devices 606, 608 and 610 can store data, programs, instructions, database queries in text or compiled form, and any other information that can be needed to operate a computer. The memories 606, 608 and 610 can be implemented as non-transitory computer-readable media (integrated or removable) such as a memory card, disk drive, compact disk (CD), or server accessible over a network. In certain examples, the memories 606, 608 and 610 can store text, images, video, and/or audio, along with appropriate instructions to make the stored data available at an associated display 616 in a human comprehensible form. Additionally, the memory devices 608 and 610 can serve as databases or data storage for the algorithm illustrated in FIGS. 42-50. Additionally or alternatively, the system 600 can access an external data source through the communication interface 612, which can communicate with the system bus 602 and the communication link 614.

In operation, the system 600 can be used to implement a control system for implementing instructions such as described herein. Computer executable logic for implementing instructions resides on one or more of the system memory 606 and the memory devices 608, 610 in accordance with certain examples. The processing unit 604 executes one or more computer executable instructions originating from the system memory 606 and the memory devices 608 and 610. The term "computer readable medium" as used herein refers to a medium that participates in providing instructions to the processing unit 604 for execution, and can include multiple physical memory components linked to the processor via appropriate data connections.

As used herein, terms of orientation and/or direction such as upward, downward, forward, rearward, upper, lower, inward, outward, inwardly, outwardly, horizontal, horizontally, vertical, vertically, distal, proximal, axially, radially, etc., are provided for convenience purposes and relate generally to the orientation shown in the Figures and/or discussed in the Detailed Description. Such orientation/direction terms are not intended to limit the scope of the present disclosure, this application and the invention or inventions described therein, or the claims appended hereto. What have been described above are examples of the present invention. It is, of course, not possible to describe every conceivable combination of components or a methodologies for purposes of describing the present invention, but one of ordinary skill in the art will recognize that many further combinations and permutations of the present invention are possible. Accordingly, the present invention is intended to embrace all such alterations, modifications, and variations that fall within the spirit and scope of the appended claims.

The invention claimed is:

1. A switch assembly for use with power equipment, the switch assembly comprising:

a housing assembly having an actuator opening, the opening defining spaced first and second internal housing positions;

a removably located actuator for selectively positioning within said opening of said housing assembly for altering the operation of power equipment;

a first switch corresponding to said first housing position to selectively provide power to one or more components of the power equipment; and a second switch corresponding to said second housing position such that the second switch is spaced away from the first housing position, the second switch for detecting the presence and position of said actuator such to further alter the operation of power equipment.

2. The switch assembly of claim 1 wherein said first switch is a reed switch.

3. The switch assembly for use with power equipment of claim 1 wherein said second switch provides an output to disable an engine in said power equipment when said actuator is located outside of said second housing member and provides an output to enable an engine in the power equipment when said actuator is located within said second housing member.

4. The switch assembly for use with power equipment of claim 1 wherein said second switch is in communication with a microcontroller configured to provide a plurality of outputs for altering the operation of said components of said power equipment based on the relative position of said actuator within said second housing member.

5. The switch assembly for use with power equipment of claim 1 wherein said second switch is configured to be engaged by mechanical operation of the actuator in the second housing position.

6. A switch assembly for use with power equipment, the switch assembly comprising:

a housing assembly defined by a first and second housing position;

a removably located actuator for selectively positioning within said first and second housing positions to alter the operation of power equipment;

a circuit comprising:

a first switch corresponding to the first housing position;

a second switch corresponding to the second housing position; and a microcontroller to receive and process signals, wherein the first and second switches detect the presence and position of the actuator in the first and second housing positions such to alter a signal to the microcontroller, wherein a signal from the first switch indicating the actuator is in a first housing position enables at least one component of the power equipment, and a signal from the second switch indicates the actuator is in the second housing position enabling a microcontroller to execute instructions controlling at least one component of the power equipment.

7. The switch assembly for use with power equipment of claim 6 wherein the circuit further comprises a starter solenoid associated with an engine of the power equipment.

8. The switch assembly for use with power equipment of claim 6 wherein the circuit further comprises a plurality of input sensors indicating operating conditions of at least one component of the power equipment, wherein the microcontroller continually monitors and compares signals from the plurality of input sensors to predetermined status conditions, the microcontroller to enable and disable at least one component of the power equipment based on the comparison.

9. The switch assembly for use with power equipment of claim 8 wherein the plurality of input sensors include at least one of a brake sensor, a seat sensor, and a gear sensor.

10. The switch assembly for use with power equipment of claim 6 wherein the at least one component of the power equipment includes at least one of a light, a status display, and a fuel gauge.

11. A method for using a switch assembly to activate power equipment comprising:

inserting a removable actuator into a first housing position of a housing assembly;

activating a first switch corresponding to the first housing position, the switch to selectively provide power to one or more components of the power equipment;

inserting the removable actuator into the second housing position of a housing assembly; and activating a second switch corresponding to the second housing position, the second switch to provide a control signal enabling the microcontroller to execute instructions to operate at least one component of the power equipment.

12. The method of claim 11 further comprising:

monitoring signals from a plurality of sensors associated with the power equipment;

comparing the signals from each sensor of the plurality of sensors with a corresponding predetermined status condition;

determine if each predetermined status condition is satisfied based on the comparison; and enable the one or more components based on the determination that each predetermined status condition is satisfied.

13. The method of claim 11 further comprising disabling the one or more components based on the determination that at least one predetermined status condition is not satisfied.

14. The method of claim 11 further comprising:

monitoring the second switch to determine the position of the actuator; and disabling power to the one or more components of the power equipment if the actuator is not in the second housing position.

15. The method of claim 11 further comprising:

monitoring the second switch to determine the position of the actuator;

monitoring a voltage divider to determine whether current is flowing to the one or more components or to one or more resistors; and disabling the voltage divider if the current is flowing to the one or more resistors and the actuator is not in the second housing position.

* * * * *